US007308228B2

(12) United States Patent
Kagita

(10) Patent No.: US 7,308,228 B2
(45) Date of Patent: Dec. 11, 2007

(54) IMAGE FORMING DEVICE AND IMAGE FORMING METHOD

(75) Inventor: Osamu Kagita, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 181 days.

(21) Appl. No.: 11/195,867

(22) Filed: Aug. 3, 2005

(65) Prior Publication Data

US 2006/0029413 A1 Feb. 9, 2006

(30) Foreign Application Priority Data

Aug. 4, 2004 (JP) ..... 2004/227699

(51) Int. Cl.
*G03G 15/00* (2006.01)

(52) U.S. Cl. ..... 399/401; 399/16; 399/81; 399/82; 399/361

(58) Field of Classification Search ..... 399/16, 399/38, 46, 66, 67, 68, 69, 81, 82, 361, 364, 399/401, 402
See application file for complete search history.

(56) References Cited

U.S. PATENT DOCUMENTS 6,188,866 B1 * 2/2001 Barnhart ..... 399/401
6,937,828 B2 * 8/2005 Hasegawa et al. ..... 399/69
2004/0037601 A1 * 2/2004 Uchida et al. ..... 399/401 X
2004/0175209 A1 * 9/2004 Sato et al. ..... 399/401 X

FOREIGN PATENT DOCUMENTS

JP 3109698 B2 9/2000

* cited by examiner

*Primary Examiner*—Sophia S. Chen
(74) *Attorney, Agent, or Firm*—Sughrue Mion, PLLC

(57) ABSTRACT

An image formation device enabling manual two-sided printing in which a user supplies the sheets, has a receiving unit, which receives printing page quantity information; a control unit, which based on the printing page quantity information determines the number of pages printed in the first pass of manual two-sided printing, issues a printing instruction for the number of pages printed, on condition that print processing has ended according to the printing instruction, issues an instruction to change image forming conditions when performing printing, and, after the change instruction, issues a printing instruction for the second pass of printing; and a printing unit, which changes the image forming conditions according to instructions to change the image forming conditions, and executes print processing according to the printing instruction.

7 Claims, 3 Drawing Sheets

IMAGE FORMING DEVICE AND IMAGE FORMING METHOD

CROSS-REFERENCE TO RELATED APPLICATIONS

This application is based upon and claims the benefit of priority from the prior Japanese Patent Application No. 2004-227699, filed on Aug. 4, 2004, the entire contents of which are incorporated herein by reference.

BACKGROUND OF THE INVENTION

1. Field of the Invention

The present invention relates to an image forming device and the like capable of printing on both sides of a sheet, and more particularly to an image forming device and the like capable of satisfactorily printing on both sides of a sheet when performing manual two-sided printing.

2. Description of the Related Art

Printers, photocopy machines, and other image forming devices have for some time performing printing on both sides of sheets, in the interest of conserving paper and for other reasons. This two-sided printing includes both so-called automated two-sided printing, in which the image forming device performs automated handling of the sheet, and so-called manual two-sided printing, in which a human again sets a sheet which has been printed on one side in the image forming device.

In this two-sided printing, after printing on one side of the sheet, printing is again performed on the other side of the sheet, so that in order to print on the other side, print processing is performed on a sheet one side of which has already been printed onto. Hence in order to perform satisfactory printing onto both sides in two-sided printing, it is desirable that the conditions for image forming be changed when printing onto one side of a sheet onto which nothing has yet been printed, and when printing onto the other side.

For example, in Japanese Patent Publication No. 3109698, it is proposed that in light of the above problem, the image forming conditions be altered when printing the first side and the second side in manual two-sided printing.

However, in the above patent reference there is no indication of the specific timing for changing the image forming conditions, and in the prior art it has not always been clear with what timing the image forming conditions should be changed when performing manual two-sided printing. And during manual two-sided printing, user operations such as manually setting the sheet are necessary when processing the second side (rear side), so that printing control for the second side (rear side) which takes into account the timing relative to user operation is necessary.

SUMMARY OF THE INVENTION

Hence an object of the invention is to provide an image forming device which enables satisfactory two-sided printing in which changing of the image forming conditions is performed with appropriate timing in manual two-sided printing.

In order to attain the above object, one aspect of this invention is an image forming device, which is capable of manual two-sided printing in which, after completing a first pass of printing to print onto one side of a sheet, when performing a second pass of printing to print onto the other side of the sheet, a user supplies the sheet, and having a receiving unit, which receives printing page quantity information; a control unit, which based on the printing page quantity information determines the number of pages printed in the first pass of manual two-sided printing, issues a printing instruction for the number of pages printed, on condition that print processing has ended according to the printing instruction, issues an instruction to change image forming conditions when performing printing, and after the change instruction issues a printing instruction for the second pass of printing; and a printing unit, which changes the image forming conditions according to instructions to change the image forming conditions, and executes print processing according to the printing instruction. Hence by means of this invention, instructions to change to image forming conditions for the second pass are issued on condition that print processing for the first pass has ended, so that regardless of whether second-pass sheets have been set or other preparations for second-pass printing have been completed, an instruction to change the image forming conditions is issued. Consequently the printing unit can quickly enter standby in the state for the second pass, and after adequately preparing a state appropriate to the second pass can perform second-pass printing, so that satisfactory printing can be executed in the second pass as well.

Further, a preferred mode of the above invention is characterized in also having an operation unit enabling the user to issue the printing instruction for the second pass to the image forming device, and is characterized in that the control unit issues an instruction to change the image forming conditions, regardless of whether the user has issues the printing instruction for the second pass through the operation unit.

In order to attain the above object, another aspect of this invention is an image forming method, in an image forming device which is capable of manual two-sided printing in which, after completing a first pass of printing to print onto one side of a sheet, when performing a second pass of printing to print onto the other side of the sheet, the user supplies the sheet, and having a first step of receiving printing page quantity information; a second step of determining the number of pages printed in the first pass of the manual two-sided printing based on the printing page quantity information; a third step of executing print processing of the determined number of pages printed in the first pass; a fourth step of changing image forming conditions when performing printing, on condition that the third step has ended; and a fifth step, after the fourth step, of executing print processing for the second pass.

Other objects and characteristics of the invention will become clear from the aspects of the invention explained below.

BRIEF DESCRIPTION OF THE DRAWINGS

FIG. 2 is a flow chart showing an example of the details of processing performed by the CPU 52 during later-stage processing; and, FIGS. 3A-3C show examples of a message displayed on the operation portion 7 or similar.

DESCRIPTION OF THE PREFERRED EMBODIMENTS

Figure 1:
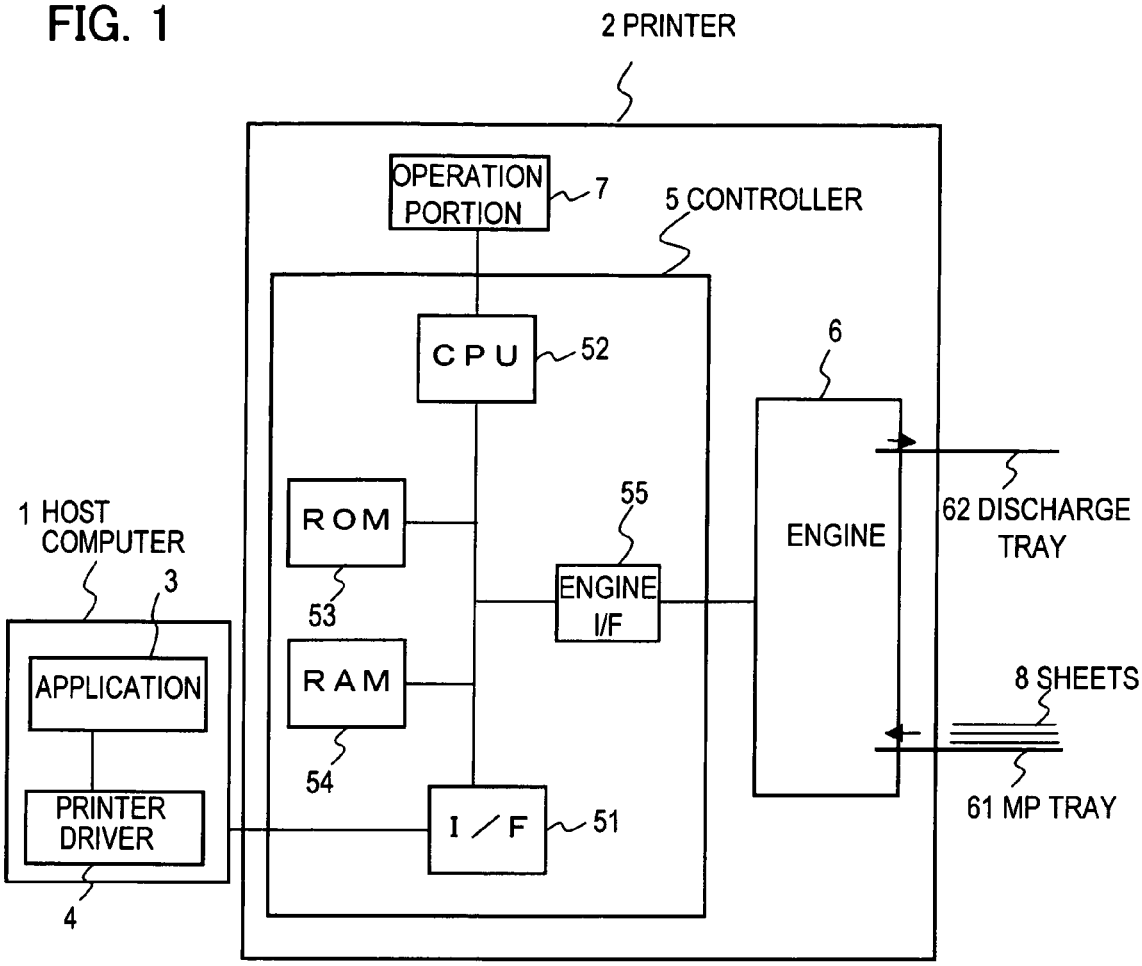
FIG. 1 shows the configuration of an embodiment of an image forming device to which this invention is applied.

Below, embodiments of the invention are explained referring to the drawings. However, these embodiments do not limit the technical scope of the invention. In the drawings, portions which are the same or similar are assigned the same reference numbers or symbols for use in explanations.

FIG. 1 shows the configuration of an embodiment of a printer which is an image forming device to which this invention is applied. The printer 2 shown in FIG. 1 is an image forming device to which this invention is applied, and based on printing requests or similar from a host computer 1, forms images on prescribed print media (sheets 8). When performing manual two-sided printing, the printer 2 changes the image forming conditions after the end of print processing of the print sheet quantity for the first side, in attempting to perform satisfactory image formation on both the first side and on the second side.

The host computer 1 shown in FIG. 1 is a host device which issues print requests to the printer 2, and transmits print data for printing to the printer 2 based on user operations or similar. The host computer 1 can comprise a so-called personal computer or similar. An application 3 within the host computer 1 is the source of print requests to the printer 2; a user issuing a print request sets the various conditions for printing via an interface provided by the application 3. Hence when a user desires manual two-sided printing, a request to this effect is issued from the application 3.

The printer driver 4 is what receives data from the application 3 and generates the print data to transmit to the printer 2. The print data comprises image data, which is the data for the image to be printed, and control commands indicating various conditions and similar at the time of printing. In the case of manual two-sided printing, the number of pages printed in manual two-sided printing (printing sheet quantity information) in the requested print job is comprised by the print data; image data for the front side and for the rear side is transmitted from the printer driver 4 to the printer 2, in a prescribed order appropriate for manual two-sided printing.

For example, in manual two-sided printing of four pages onto two sheets, image data is transmitted in the order of the fourth page, second page, first page, third page. In response, the printer 2 first prints the fourth page and the second page on one side of the two sheets 8, and then prints the first page and the third page on the opposite sides of the two sheets 8. In this two-sided printing, the print processing for the sides printed first (in the above example, printing of the fourth page and the second page) is here called first-pass printing, and the print processing for the sides printed afterward (in the above example, printing of the first page and the third page) is here called second-pass printing.

In the printer driver 4, processing to convert image data expressed in PDL and describing each object into image data represented by density values for each pixel, processing after this conversion to convert color expressions of image data into color expressions during printing by the printer 2, subsequent processing to compress this data, and other processing is performed. That is, in this embodiment a so-called host-based system is assumed. The printer driver 4 is a program which causes the host computer 1 to execute processing related to the above functions; the above functions are realized by the execution of processing by a control device (not shown) of the host computer 1 according to the program.

The printer 2 is a so-called four-cycle laser printer which receives print data transmitted from the host computer 1 and executes printing in page units, and as shown in FIG. 1 comprises a controller 5, engine 6, and operation portion 7. The controller 5 comprises an I/F 51, CPU 52, ROM 53, RAM 54, and engine I/F 55.

The I/F 51 is a portion which receives the print data transmitted from the host computer 1. The ROM 53 is a portion which stores various programs to control the printer 2. The RAM 54 is memory which stores the received print data and similar; image data for each page, print processing of which is performed by the engine 6, is passed from here to the engine I/F 55.

The CPU 52 is a portion which controls the various processing performed in the printer 2, and in particular governs processing to store in RAM 54 the image data comprised by the received print data, processing to interpret control commands comprised by the print data and to issue instructions for appropriate print processing to the engine 6, and processing to control the operation portion 7 which constitutes the interface with the user. A characteristic of this printer 2 is in these processings when there is a request for manual two-sided printing from the host computer 1; the specific details of the processing are described below. Processing executed by the CPU 52 is mainly performed according to a program stored in ROM 53.

The engine I/F 55 is a portion which when executing printing through the engine 6, reads image data stored in the above-described RAM 54 with prescribed timing, subjects the data to prescribed processing, then passes the data to the engine 6, and governs the interface between the controller 5 and engine 6. Though not shown, the engine I/F 55 comprises memory to temporarily store data, a decompression portion, a screen processing portion and similar, and performs decompression of compressed image data read from RAM 54, performs screen processing for conversion into dot data, and similar. More specifically, the engine I/F 55 comprises an ASIC.

Each of the portions of the controller 5 described above are interconnected so as to enable data exchange, as shown in FIG. 1.

The engine 6 is a portion which executes print processing based on data output from the engine I/F 55, to perform image forming on sheets 8 or other print media. Similarly to an ordinary laser printer, the engine 6 comprises a charging unit, exposure unit, developing device, transfer unit and similar (not shown). When performing manual two-sided printing, the charging voltage, transfer voltage, and other image forming conditions in the above portions are set to conditions appropriate for the first pass and for the second pass respectively to perform print processing. In the final stage of the above print processing, transfer is performed from the transfer unit onto a sheet 8 supplied from the MP tray 61 which is the sheet supply tray, and after fixing processing by the fixing unit (not shown), the printed sheet 8 is discharged to the discharge tray 62. This printer 2 is configured comprising only an MP tray 61 as the sheet supply tray, but enabling addition of another sheet supply tray.

The operation portion 7 is a portion for operation of the printer 2 by the user, and comprises a display panel 71 and various operation buttons and similar. Using the operation portion 7, various print condition settings in the printer 2 can be set, and also messages are displayed and print execution instructions are issued for manual two-sided printing.

The following is an explanation of the action of a printer 2 of this embodiment, having the configuration described above. As stated above, a characteristic of this printer 2 is the processing during manual two-sided printing, and so the details of processing during manual two-sided printing are explained. First, when a print request for manual two-sided printing is issued from the host computer 1, the print data for the print request is received by the I/F 51. Control commands comprised by the received print data are sent to the CPU 52 and interpreted, and the various printing conditions for the print job are determined.

At this time, the number of pages for manual two-sided printing in the print job comprised by the print data is ascertained, and from the fact that the number is not zero, the CPU 52 judges that the print job entails manual two-sided printing, and executes control for manual two-sided printing, explained below, at the time of print processing by the engine 6. Moreover, the number of pages in the first-pass printing and the number of pages in the second-pass printing are determined from the above ascertained the number of pages for manual two-sided printing.

Image data for each page comprised by the received print data is stored in sequence in RAM 54, and is held in RAM 54 until the prescribed timing for starting print processing by the engine 6.

For example, when a request for four pages' worth of manual two-sided printing is received from the host computer 1, the information that the number of pages for the manual two-sided printing of the print job is four pages is comprised by the received print data, and so the CPU 52 judges that this print job entails manual two-sided printing, recognizes that the number of pages for both the first pass and for the second pass is two pages, and, because the four pages' worth of image data is transmitted in the order appropriate for manual two-sided printing, stores the image data sequentially in that order in RAM 54. For example, as described above, the image data is stored in the order of the fourth page, the second page, the first page, and the third page.

In this way, early-stage processing in the printer 2, that is, processing to receive and store print data is performed, but during this early-stage processing or afterward, later-stage processing in the printer 2, that is, processing to print to sheets 8 based on the received data, is performed. This later-stage processing is initiated with prescribed timing according to the state of reception of image data, the state of the engine 6 and similar, and is performed in page units. A major characteristic of this printer 2 is in the details of the processing of the CPU 52 in this later-stage processing; below, these details are explained.

Figure 2:
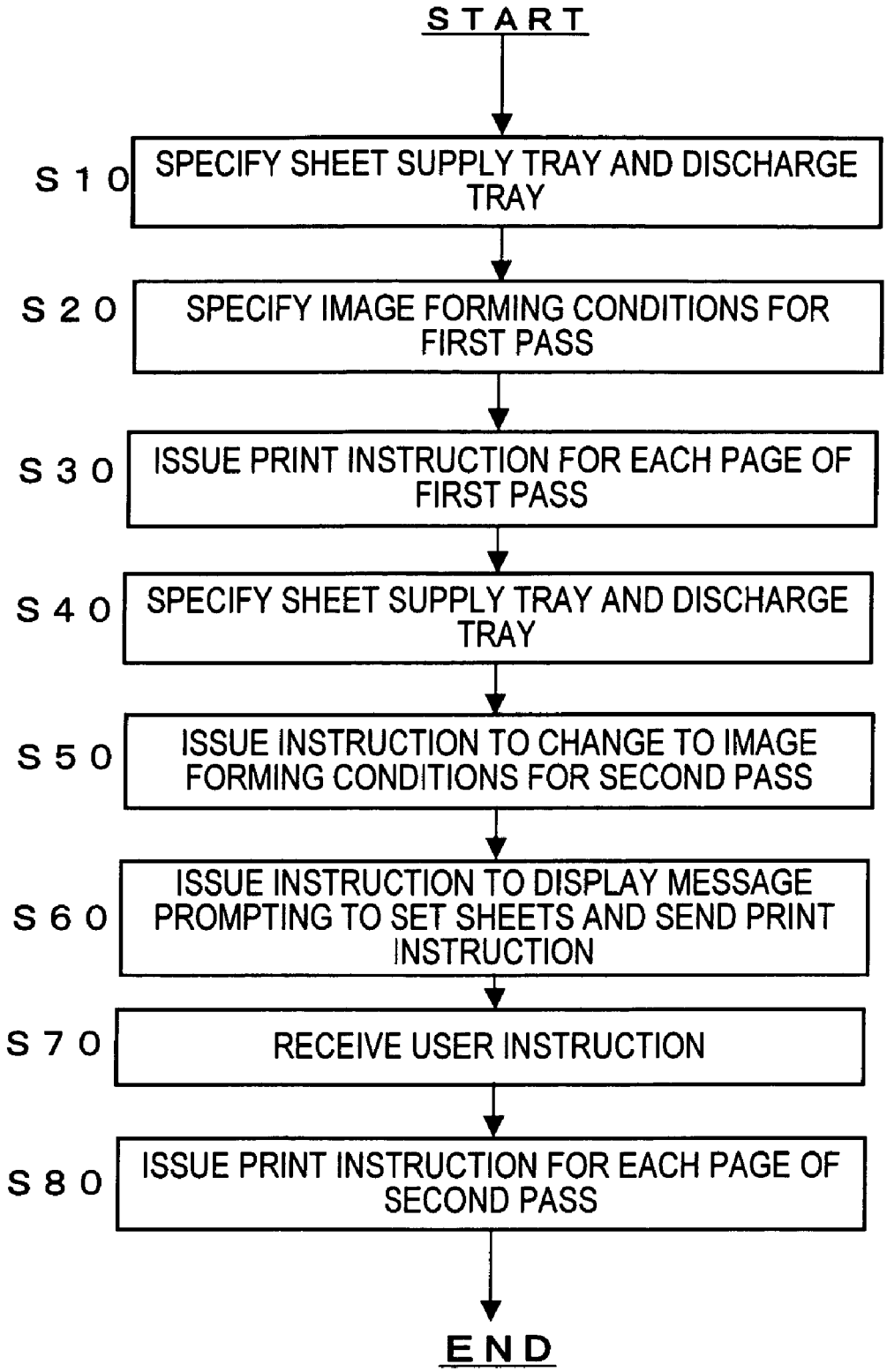

FIG. 2 is a flow chart showing an example of processing details for one job performed by the CPU 52 during later-stage processing. When in a print job for which manual two-sided printing has been requested the timing arrives at which print processing for the first page of the first pass may be begun, the CPU 52 specifies, to the engine 6, the sheet supply tray and the discharge tray to be used in the first pass (step S10). When the MP tray 61 is the only sheet supply tray, the MP tray 61 is specified as the sheet supply tray, but when there are a plurality of sheet supply trays, a tray specified by the user, or any arbitrary tray, can be specified. As the discharge tray, the discharge tray 62 is specified.

Next, the CPU 52 specifies the first-pass image forming conditions for the engine 6 (step S20). Specifically, as explained above, the charging voltage, transfer voltage, and other parameters are specified for the first pass. In the first pass, image forming conditions similar to those for single-side printing are specified.

Thereafter, the CPU 52 issues to the engine 6 an instruction to perform print processing for each page of the first pass in sequence (step S30). The print processing instruction is first issued for the first page to be printed in the first pass, and thereafter, instructions are issued for print processing of the next page when the timing to begin print processing of the next page by the engine 6 has been reached, according to the state of processing of the first page in the engine 6 and according to the state of progress of early-stage processing for the next page. Subsequently and in a similar manner, instructions are issued for the above print processing at the timing for beginning print processing for each of the pages of the first pass.

Instructions for print processing for each page are, more specifically, instructions to the engine 6 for sheet supply, instructions to begin transfer to the engine 6 of the image data for each page, and similar.

When this print instruction is issued, sheet supply from the specified sheet supply tray is begun by the engine 6 for the specified pages, while image data stored in RAM 54 is read in sequence and, after performing prescribed processing at the engine I/F 55, is passed to the engine 6. Thereafter, printing onto supplied sheets 8 is executed by the engine 6 based on the transferred image data. According to the print instruction, this print processing by the engine 6 is executed for each page of the first pass.

When the above-described request for manual two-sided printing of four pages' worth is received, the print instruction and the print processing according to the instruction are performed in sequence for the fourth page and the second page, which constitute the first pass.

When print processing by the engine 6 for all the pages in the first pass ends, the CPU 52 begins processing for the second pass of the job; first, the sheet supply tray and discharge tray to be used in the second pass are specified to the engine 6 (step S40). When a plurality of sheet supply trays are comprised, the sheet supply tray for the second pass is fixed at the MP tray 61.

Next, the CPU 52 issues an instruction to the engine 6 to change to the image forming conditions for the second pass (step S50). In this second pass, as explained above, print processing is performed on sheets 8 already subjected to printing on one side, and so processing must be performed with image forming conditions different from those for the first pass. Hence a transfer voltage and similar which are different from the values for the first pass are specified. Thus when performing manual two-sided printing using the printer 2, after the end of first-pass print processing the image forming conditions are changed. That is, the CPU 52, upon the condition of receiving from the engine 6 a report indicating the end of first-pass print processing, issues an instruction to change to the image forming conditions for the second pass. This is a major characteristic of the printer 2. Specifically, the end of the first-pass print processing is judged on the basis of whether the last page of the first pass has been discharged to the discharge tray 62, whether the last page of the first pass has traveled through a part (location) which is changed in the second-pass conditions, and similar.

Next, the CPU 52 issues an instruction to the operation portion 7 to display a message prompting the user to set the sheets 8 for the second pass and to specify second-pass printing (step S60). The instruction to display this message may be issued after the instruction to change image forming conditions (S50), or may be issued in parallel with the above-described steps S40 and S50 after the end of the first-pass print processing. FIG. 3 shows examples of messages displayed in the operation portion 7 or similar as a result of this instruction.

Figure 3A:
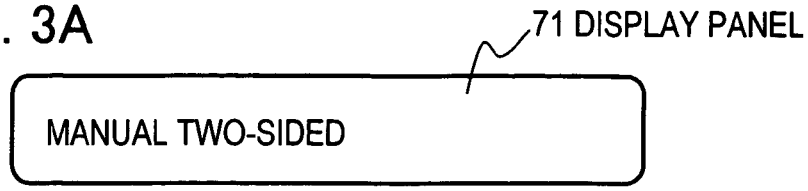
Figure 3B:
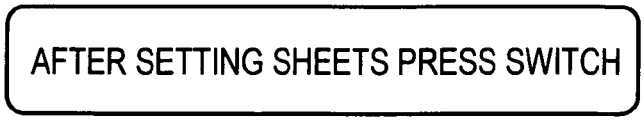

In the example of FIG. 3A, "MANUAL TWO-SIDED" is displayed in the display panel 71 of the operation portion 7; the user reconfirms that manual two-sided printing is being performed, and understands that the timing to perform the operation of setting the sheets 8 for the second pass in the MP tray 61 according to the procedure for manual two-sided printing described in a manual (User Operation Manual) for the printer 2, and pressing a switch to enable printing provided on the operation portion 7 has arrived. In the example of FIG. 3B, "AFTER SETTING SHEETS PRESS SWITCH" is displayed in the display panel 71. According to this message, the users knows that the timing to set the sheets 8 for the second-pass printing in the MP tray 61 and to press the switch to enable printing has arrived.

Figure 3C:
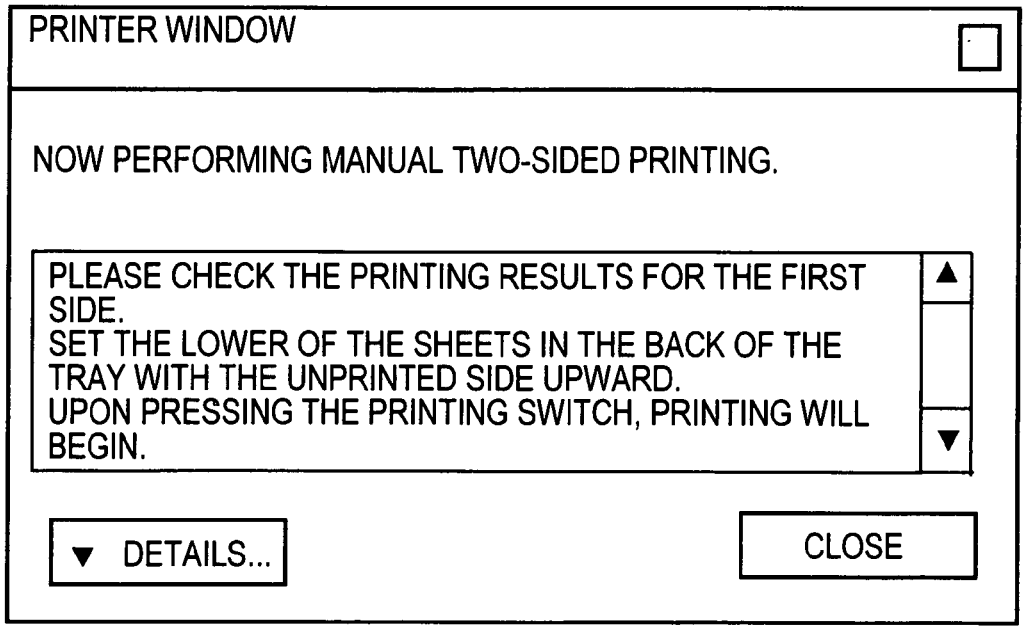

This message display may also be performed at the host computer 1. That is, an instruction may be issued to display the message on a display device (not shown) comprised by the host computer 1. FIG. 3C shows an example of a message displayed at the host computer 1. Normally the host computer 1 affords a greater display area, so that as shown in the drawing, a more thorough message can be displayed than in the case of display on the operation portion 7. A user at the host computer 1 is prompted by this message to set the sheets 8 for the second pass and to press the switch to enable printing. The message may also be displayed at both the operation portion 7 and at the host computer 1.

When such a message is displayed, the user sets the sheets 8 discharged in the discharge tray 62, and onto which the first-pass printing has been performed, in the MP tray 61 with the prescribed orientation, and then presses the switch to enable printing on the operation portion 7. That is, an instruction is issued to the effect that second-pass print processing may be performed. In the above example of performing four pages' worth of manual two-sided printing, the two sheets 8 onto which the fourth page and the second page have been printed are retrieved from the discharge tray 62 and set in the MP tray 61.

When the switch to enable printing is thus pressed by the user, that is, when the user issues the instruction for the second-pass printing, the CPU 52 receives this user instruction (step S70), and instructs the engine 6 to perform print processing of each page of the second pass, in sequence (step S80). Here, similarly to the above-described case of step S30, paper feed instructions, image data transfer begin instructions, and other print processing instructions are issued with the timing for starting the print processing for each page.

When these print instructions are issued, sheet feeding from the specified MP tray 61 is begun by the engine 6 for the specified page, and image data stored in RAM 54 is read in sequence and is passed, after being subjected to prescribed processing by the engine I/F 55, to the engine 6. Then, the engine 6 executes printing onto the supplied sheet 8 based on the transferred image data.

When a request is received for the above-described four pages' worth of manual two-sided printing, these printing instructions, and the print processing based thereupon, are performed in sequence for the first page and third page which constitute the second pass.

When print processing by the engine 6 ends for all the pages in the second pass, processing by the printer 2 of the manual two-sided printing ends.

The operation by the user to issue a print instruction (to press the switch to enable printing), instructing the beginning of second-pass printing, may be omitted. That is, display of the message prompting the user to issue a printing instruction in the above-described step S60, and reception of the user instruction in step S70, may be omitted. In this case, after the sheets 8 for the second pass are set, a printing instruction is issued (S80) for each of the pages of the second pass.

In the explanation based on the above FIG. 2, specification of the paper feed tray and discharge tray, and instruction of settings for image forming conditions, are performed for each pass, that is, at the beginning of the processing for the first pass and at the beginning of the processing for the second pass; but these may be performed for each page. In this case, when setting the image forming conditions for the first page of the second pass, changing to image forming conditions different from the conditions used up till then is performed, the change timing is after completion of all print processing for the first pass.

As explained above, when manual two-sided printing is performed using the printer 2 of this embodiment, the number of pages in the first pass is ascertained from the printing page quantity, and on the condition that this number of pages of print processing has ended, an instruction is issued to change the image forming conditions. Consequently regardless of whether second-pass sheets have been set or other preparations for second-pass printing have been completed, an instruction is issued to change to the image forming conditions for the second pass. Moreover, when beginning second-pass printing after having received a second-pass printing instruction from the user, an instruction is issued to change the image forming conditions at the end of the first-pass printing, regardless of the user instruction. By thus issuing an instruction to change the image forming conditions with this timing, the engine 6 can be set to the specified conditions for each part at an early stage; in other words, standby in the state for the second pass can be entered quickly, and after adequately establishing a state appropriate to the second pass, second-pass printing is performed, so that satisfactory printing can be executed in the second pass as well. Normally in manual two-sided printing, after the end of the first pass, for setting the sheets for the second pass are set by a human, or for other reasons some time is required until the beginning of second-pass printing; but in the case of this printer 2, this time is utilized in image forming condition changes which require time, such as changing the fixing temperature, so that such changes are performed thoroughly.

Further, in the case of this printer 2 the user does not directly issue an instruction to change the image forming conditions, but the CPU 52 of the controller 5 automatically issues an instruction, so the user is not troubled with the need to issue an instruction.

Thus by using the printer 2 when performing manual two-sided printing, the necessary changes to the image forming conditions during two-sided printing are automatically executed with appropriate timing, and satisfactory printing can be performed efficiently on both sides.

In this embodiment, the printer 2 is a four-cycle laser printer; but the printer may be a so-called tandem type printer or a monochrome printer. Also, the printer may be an inkjet printer or a printer which uses a different printing method. In this embodiment, a so-called host-based system is assumed; but this invention can be applied even when the system is not a host-based system. Moreover, this invention can be applied not only to printers, but to photocopy machines and other image forming devices.

The scope of protection of this invention is not limited to the above embodiment, but extends to the inventions described in the scope of the claims and to inventions equivalent thereto.

What is claimed is:

1. An image forming device, capable of manual two-sided printing in which, after completion of a first pass of printing to print onto one side of a sheet, when performing a second pass of printing to print onto the other side of the sheet, a user supplies the sheet, the image forming device comprising:

a receiving unit, which receives printing page quantity information;

a control unit, which based on said printing page quantity information determines the number of pages printed in the first pass of said manual two-sided printing, issues a printing instruction for said number of pages printed, issues an instruction to change image forming conditions if print processing has ended according to said printing instruction for said number of pages, regardless of whether the pages have been set for the second pass of printing, and after issuing said instruction to change image forming conditions, issues a printing instruction for the second pass of printing; and, a printing unit, which changes the image forming conditions according to said instruction to change the image forming conditions, and executes print processing according to said printing instruction for the second pass of printing.

2. The image forming device according to claim 1, further comprising an operation unit to enable the user to issue said printing instruction for the second pass of printing to said image forming device, and wherein said control unit issues said instruction to change the image forming conditions regardless of whether said user has issued said printing instruction for the second pass of printing using said operation unit.

3. The image forming device of claim 2, wherein the operating unit displays a message prompting the user to set the pages for the second pass of printing and to issue said printing instruction for the second pass of printing.

4. An image forming method, in an image forming device capable of manual two-sided printing in which, after completion of a first pass of printing to print onto one side of a sheet, when performing a second pass of printing to print onto the other side of the sheet, a user supplies the sheet, the method comprising:

receiving printing page quantity information;

determining the number of pages printed in the first pass of said manual two-sided printing based on said printing page quantity information;

executing print processing for said determined number of pages printed in the first pass;

changing image forming conditions if the executing print processing for the determined number of pages has ended, regardless of whether the pages have been set for the second pass of printing; and, after said changing image forming conditions, executing print processing for said second pass of printing.

5. The image forming method according to claim 4, further comprising enabling the user to issue a printing instruction for the second pass of printing, wherein the changing image forming conditions is performed regardless of whether said user has issued said printing instruction for the second pass of printing.

6. The image forming method according to claim 5, further comprising displaying a message which prompts the user to set the pages for the second pass of printing and to issue said printing instruction for the second pass of printing.

7. An image forming device, capable of manual two-sided printing in which, after completion of a first pass of printing to print onto one side of a sheet, when performing a second pass of printing to print onto the other side of the sheet, a user supplies the sheet, the image forming device comprising:

a receiving unit, which receives printing page quantity information;

a control unit, which based on said printing page quantity information determines the number of pages printed in the first pass of said manual two-sided printing, issues a printing instruction for said number of pages printed, issues an instruction to change image forming conditions if print processing has ended according to said printing instruction for said number of pages printed, and after issuing said instruction to change image forming conditions, issues a printing instruction for the second pass of printing;

a printing unit, which changes the image forming conditions according to said instruction to change the image forming conditions, and executes print processing according to said printing instruction for the second pass of printing; and an operation unit to enable the user to issue said printing instruction for the second pass of printing to said image forming device, wherein said control unit issues said instruction to change the image forming conditions regardless of whether said user has issued said printing instruction for the second pass of printing using said operation unit.

* * * * *